US005580049A

United States Patent [19]

Brantley

[11] Patent Number: 5,580,049

[45] Date of Patent: Dec. 3, 1996

[54] SOCCER BALL WITH FIBER REINFORCED POLYURETHANE COVER

[75] Inventor: Derrick K. Brantley, East Longmeadow, Mass.

[73] Assignee: Lisco, Inc., Tampa, Fla.

[21] Appl. No.: 493,835

[22] Filed: Jun. 22, 1995

[51] Int. Cl.[6] ..... A63B 41/02; A63B 41/08

[52] U.S. Cl. ..... 273/65 B; 273/DIG. 8; 273/ 58 BA

[58] Field of Search ..... 273/DIG. 8, 58 B, 273/58 BA, 65 R, 65 B

[56] References Cited

U.S. PATENT DOCUMENTS

| | | | |
|---|---|---|---|
| 3,119,618 | 1/1964 | Molitor et al. | 273/DIG. 8 |
| 3,976,295 | 8/1976 | Heald, Jr. | 273/60 R |
| 4,093,219 | 6/1978 | Piraud | 273/65 B |
| 4,149,720 | 4/1979 | Heald, Jr. | 273/60 R |
| 4,169,594 | 10/1979 | Crane | 273/58 BA |
| 4,256,304 | 3/1981 | Smith et al. | 273/60 B |
| 4,333,648 | 6/1982 | Aoyama | 273/65 EB |
| 4,462,590 | 7/1984 | Mitchell | 273/65 E |
| 4,515,852 | 5/1985 | Katabe et al. | 428/246 |
| 4,653,752 | 3/1987 | Miller | 273/60 B |
| 4,660,830 | 4/1987 | Tomar | 273/60 B |
| 4,725,058 | 2/1988 | Molitor | 273/60 B |
| 4,840,378 | 6/1989 | Molitor | 273/60 B |
| 4,880,233 | 11/1989 | Song | 273/60 R |
| 5,069,935 | 12/1991 | Walters | 427/209 |
| 5,091,265 | 2/1992 | Kennedy et al. | 428/690 |
| 5,098,097 | 3/1992 | Kennedy et al. | 273/65 EC |
| 5,310,178 | 5/1994 | Walker et al. | 273/65 B |

*Primary Examiner*—George J. Marlo

[57] ABSTRACT

A soccer ball having a high end synthetic cover formed from a non-woven fiber mat impregnated with polyurethane. The fibers in the backing of the cover material have a denier of about 0.02 or less. The soccer ball, which can be formed to meet association specifications, has a cover formed from a fiber reinforced polyurethane material having a Shore A hardness of 40–80 and stitch tear strength of at least 45 psi, thereby imparting to the cover a favorable combination of softness and durability.

23 Claims, 1 Drawing Sheet

SOCCER BALL WITH FIBER REINFORCED POLYURETHANE COVER

BACKGROUND OF THE INVENTION

This invention generally relates to soccer balls, and more particularly to an improved soccer ball having an interior inflatable bladder, an intermediate liner, and a cover made of a synthetic material.

Soccer ball covers frequently are made of polyvinylchloride (PVC) and/or polyurethane based materials. The backing of these materials traditionally has been either a woven fabric or an impregnated non-woven fabric with a fiber size of at least about 0.1 denier. Synthetic cover materials of this type are durable but lack softness.

SUMMARY OF THE INVENTION

An object of the invention is to provide a new and improved soccer ball having a high performance, synthetic leather stitched cover that exhibits softness while maintaining durability.

Another object of the invention is to provide a soccer ball of the type described below having a synthetic stitched cover wherein the ball has properties such as softness which replicate, or are superior to, the properties of prior known soccer balls.

A further object of the invention is to provide a synthetic covered soccer ball for use in competitive play which has improved wear, feel and handing characteristics, as well as good durability.

A still further object of the invention is to provide a soccer ball having a cover of durable, fiber reinforced polyurethane in place of the high end synthetic soccer ball covers which were previously known.

Other objects of the invention will be in part obvious and in part pointed out more in detail hereinafter.

The invention in a preferred form is a soccer ball having an interior inflatable bladder formed in a generally spherical shape, a cover secured over the bladder, which includes a backing and an outer coating formed thereon, and a liner between the bladder and the cover. The backing includes a fiber reinforced polyurethane material comprising fibers having a denier of about 0.02 or less, more preferably 0.01 or less and most preferably 0.005–0.009. The fibers in the backing are formed from a polyamide and/or a polyester.

In a particularly preferred form of the invention, at least about 50% of the fibers in the backing have a denier of 0.009 or less, and most preferably at least about 80% of the fibers have a denier of about 0.009 or less. In a most preferred form, substantially all of the fibers have a denier of about 0.008 or less.

The outer coating of the soccer ball cover preferably comprises a polyurethane, such as a non-fiber-reinforced polyurethane, but alternatively can comprise a rubber compound, such as natural rubber, styrene-butadiene rubber or isoprene rubber, polyvinyl chloride, polyurea, ethylene propylene diene monomer (EPDM) and mixtures thereof.

The soccer ball cover is softer and has better feel than prior known synthetic soccer ball covers which have comparable durability. Preferably, the fiber reinforced polyurethane cover material for the soccer ball of the invention has a Shore A hardness of about 65 or less.

A better understanding of objects, advantages, features, properties and relationships of the invention will be obtained from the following detailed description wherein the features of construction, combination of elements and arrangement of parts will be exemplified and are indicative of the way in which the principles of the invention are employed.

DETAILED DESCRIPTION OF THE INVENTION

Figure 1:
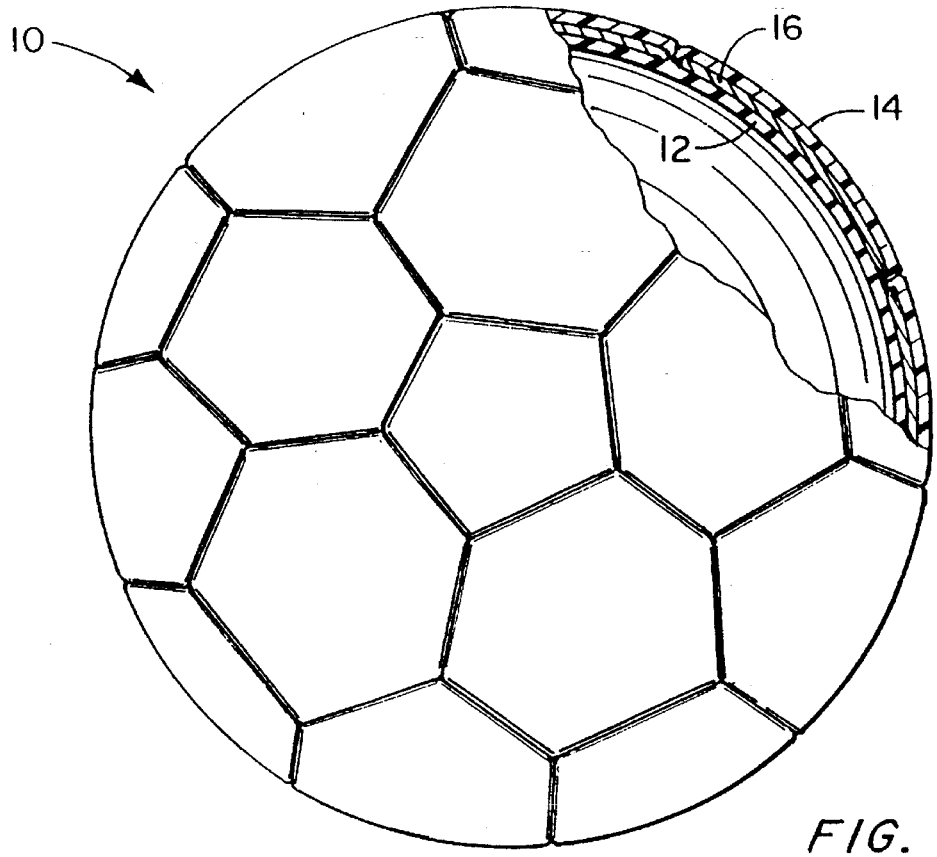
FIG. 1 is a side elevational view, partially cut away, of a soccer ball which is configured according to the present invention.

A soccer ball is made up of three major components, namely (1) an interior balloon or bladder 12, (2) a cover made of panels of a synthetic material, such as PVC or polyurethane, and (3) a liner 16 positioned between the bladder and the cover. Optionally, an intermediate foam layer (4) (not shown) is included between the liner and cover. A soccer ball 10 for use in competitive play has a weight of 380–460 grams and a diameter of 21–23 cm.

More specifically, the bladder 12 has an spherical shape and is adapted to be filled with air. The preferred material for the bladder 12 is butyl rubber or latex. Other suitable materials include, but are not limited to, natural rubber, mixes of butyl rubber and natural rubber, polyurethane. The bladder 12 is of a size suitable to result in a soccer ball 10 having the diameter noted above.

The liner 16 preferably is formed of a relatively non-elastic material such as a woven fabric made of 2–4 ply yarns or a woven fabric of multi-ply yarns embedded with a PVC for further stability. The liner 16 typically consists of 32 panels.

If an additional foam layer is used, this layer typically has a thickness of about 2 mm. Material for foam layers to be used in soccer balls is available from Interep S.A. (France).

The cover 14 of the soccer ball is formed from 32 hexagonal panels which are cut to an appropriate size, stitched to a corresponding lining panel and then stitched to each other. If used, the foam layer is sandwiched between the cover 14 and the liner 16 prior to stitching.

Figure 2:
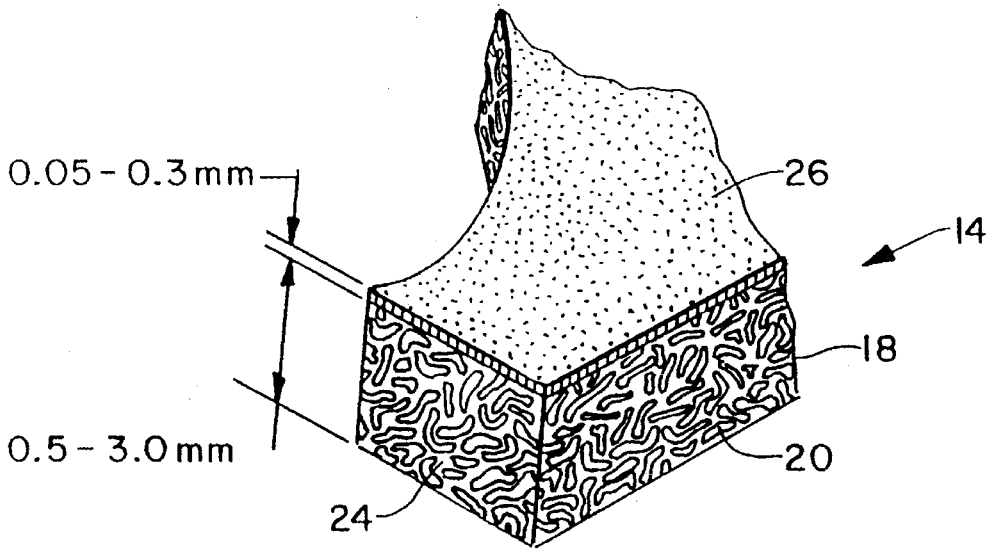
FIG. 2 is an enlarged schematic view of the cover which is used to form the soccer ball of the present invention.

As shown in FIG. 2, the cover material 18 which is used in the soccer ball of the invention preferably is formed from a plurality of monofilament polymeric fibers 20 compressed together in an array to form a mat with polyurethane material 24 located above, below, and throughout the spaces between the non-woven fibers 20. Typically, the polymeric fibers 20 have a core of a polyamide or polyester which is coated with an outer shell of a material such as a polyethylene, e.g., a low density polyethylene (LDPE). The fibers 20 preferably have a denier of about 0.02 or less, more preferably $5.10^{-5}$-0.01 and most preferably 0.005–0.009. This is a size significantly smaller than the fibers traditionally used to form synthetic soccer ball covers. It has been found that this smaller size results in a synthetic leather soccer ball cover 14 which is softer than known soccer ball covers and has sufficient durability, i.e., shape-retaining characteristics. The cover material 18 preferably has a basis weight of 600–1400 g/m$^2$, more preferably 800–1100 g/m$^2$, and most preferably about 850–900 g/m$^2$.

A preferred technique for fabrication of the cover material 18 which is used in one embodiment of the soccer ball is to form an impregnation of fibers 20 with polyurethane material 24. The material subsequently undergoes an extraction process to give the material a soft feel. The outer surface of the material is then coated with a top coat 20. The top coat 26 on the material also can be polyurethane, and can be, but need not necessarily be, the same material that is used to impregnate the fibers 20. A polyester-based polyurethane is useful. Other coating resins which adhere to the fiber reinforced polyurethane and which do not adversely affect the soft feel of the cover material 18 also can be used as the top coat 26.

One preferred process for preparing the soccer ball cover material 18 includes the formation of the substrate which is prepared by providing a mat of fibers 20 comprising polyamide and/or polyester with a fiber denier of about 0.007 in a mat thickness appropriate to result in a final uncoated cover material thickness of about 0.5–3.0 mm, more preferably 1.0–2.0 mm, and most preferably about 1.3–1.7 mm. Optionally, each fiber 20 is coated with a starch.

More specifically, a solution of polyurethane elastomer, with sorbitan monostearate and stearyl alcohol as optional additives in an amount of a few percent by weight, is forced into the non-woven fabric of mat fibers 20 which have a core of, e.g., Nylon 6 and an outer shell of, e.g., LDPE, and the solution impregnates the non-woven fabric. Then, the base material with the polyurethane coating layer is put into an aqueous solution. This coagulates the solution of polyurethane elastomer and, during this wet coagulation process, the polyurethane elastomer changes the fibers 20 into a microporous structure to form a cellular plastic. In this coagulation process, the additives work as an accelerator to get more micropores and/or as a controller of the size of the pores. The coagulation process provides for the soft feel of the cover material.

The sheet material formed by the above described process is then washed in DMF, and is subsequently dipped in toluene for a period of time sufficient to dissolve off the polyethylene outer shell of the fiber 20. At the same time, the special additives, if used, are extracted or removed out of the sheet material for softening of the material. If the fibers 20 have been coated with a starch, a certain amount of starch deposited on the surface of non-woven fabric has, at this time, already been removed out of the sheet materials during the process of coagulation.

The extracted sheet material is dried. Subsequently, a top coat 26 of polyurethane or another suitable top coat material is applied to the sheet material by, e.g., lamination or a gravure coating process.

Typically, for a soccer ball 10 with a cover material having a non-fiber-reinforced coating and an uncoated thickness in the range of 0.5–3 mm, the outer coating or top coat 26 has a thickness of about 0.05–0.3 mm, and more preferably about 0.1–0.2 mm. It is noted that covers 14 with greater thicknesses can be used as long as the favorable playability properties of the soccer ball 10 are maintained.

The use of the reinforced polyurethane cover 14 of the invention has been found to provide wear, feel and/or handling characteristics to the soccer balls 10 which are superior to the characteristics of conventional soccer balls. The balls of the invention meet rebound and weight requirements for regulation soccer balls.

The cover material 18 alone, when tested for physical properties and compared to current raw material specifications for both polyurethane and PVC, meets or exceeds all requirements for soccer ball covers. Accordingly, the cover material 18 can be appropriately stitched to meet not only manufacturing requirements for the balls, but also the standard field play requirements for durability.

The cover material 18 for the soccer ball has a thickness of about 0.5–2.5 mm, preferably 1.0–2.0 mm, and more preferably 1.3–1.6 mm. The Shore A hardness of the cover material 18 preferably is about 40–80, more preferably 60 to 70 and most preferably 64–67. The stitch tear strength of the cover material 18 preferably is at least 45 p.s.i., more preferably at least 50 p.s.i., and most preferably at least 55 p.s.i. Cover material 18 of the invention with a thickness of about 1.5 mm and a Shore A hardness of about 64–67 typically has a durability that is comparable to that of commercially available conventional polyurethane soccer ball cover material which has a thickness of about 1.35 mm and a Shore A hardness of about 72–75.

From a subjective standpoint, the difference between the soccer ball of the invention and soccer balls covered with other synthetics is obvious to the touch. The ball of the invention has a distinctly soft feel as compared to conventional soccer ball covers. Other known synthetic soccer ball covers have a harder, more plastic-like feel.

The soccer ball of the invention preferably is assembled in the following manner. Thirty-two hexagonal, painted cover panels (e.g., ZU-3030, Kuraray, Osaka, Japan) and thirty-two hexagonal liner panels are cut. The liner components are stitched to individual cover panels along their peripheries. The edges of thirty-one the panels and liner components are then stitched together along their edges forming seams and creating a spherical shell for receiving a pre-molded bladder. The stitching is made while the panels and liner are inside out. The cover is subsequently turned right side out, the bladder is inserted, and the final panel is stitched into place.

As will be apparent to persons skilled in the art, various modifications and adaptations of the structure above described will become readily apparent without departure from the spirit and scope of the invention.

What is claimed is:

1. A soccer ball, comprising:

an interior inflatable bladder formed in a generally spherical shape, a cover secured over the bladder, the cover being formed from a plurality of panel segments, each of which includes a backing and an outer coating formed thereon, the backing comprising a fiber reinforced polyurethane material having a Shore A hardness of 40–80 and a stitch tear strength of at least 45 psi and containing fibers having a denier of 0.02 or less, and a liner positioned between the bladder and the cover.

2. A soccer ball according to claim 1, wherein at least 50% of the fibers in the backing have a denier of 0.01 or less.

3. A soccer ball according to claim 1, wherein the fibers in the backing have a denier of 0.009 or less.

4. A soccer ball according to claim 1, wherein the backing fibers comprise a polyamide.

5. A soccer ball according to claim 1, wherein the backing fibers comprise a polyester.

6. A soccer ball according to claim 1, wherein the outer coating comprises a polyurethane.

7. A soccer ball according to claim 1, wherein the cover has a microporous cellular structure.

8. A soccer ball according to claim 1, wherein the backing has a thickness of 3.0 mm or less.

9. A soccer ball according to claim 1, wherein the backing has a thickness of 2.0 mm or less.

10. A soccer ball according to claim 1, wherein the backing has a thickness of 1.6 mm or less.

11. A soccer ball according to claim 1, wherein the cover backing has a basis weight of about 600–1400 g/m$^2$.

12. A soccer ball according to claim 1, wherein the backing comprises a fiber reinforced polyurethane material having a Shore A hardness of 64–67, a thickness of 1.5 mm, and a durability comparable to that of a backing made from a fiber reinforced polyurethane material having a Shore A hardness of 72–75, a thickness of 1.35 mm, and a fiber size of at least about 0.1 denier.

13. A soccer ball according to claim 1, wherein the cover and the liner each comprise a plurality of panels, and each cover panel is positioned directly over and in contact with a liner panel.

14. A soccer ball, comprising:

an interior inflatable bladder formed in a generally spherical shape, a cover secured over the bladder, the cover being formed from a plurality of panel segments, each of which includes a backing and an outer coating formed thereon, the backing comprising a fiber reinforced polyurethane material having a Shore A hardness of 60–70 and a stitch tear strength of at least 55 psi and containing fibers having a denier of 0.02 or less, and a liner positioned between the bladder and the cover.

15. A soccer ball according to claim 14, wherein the fibers in the backing have a denier of 0.01 or less.

16. A soccer ball according to claim 14, wherein the fibers in the backing comprise a polyamide.

17. A soccer ball according to claim 16, wherein the outer coating comprises a polyurethane.

18. A soccer ball according to claim 14, wherein the outer coating comprises a polyurethane.

19. A soccer ball according to claim 18, wherein the backing has a thickness of 3.0 mm or less.

20. A soccer ball according to claim 14, wherein the backing has a microporous cellular structure.

21. A soccer ball according to claim 14, wherein the backing has a thickness of 3.0 mm or less.

22. A soccer ball according to claim 14, wherein the backing has a basis weight of about 600–1400 g/m$^2$.

23. A soccer ball according to claim 14, wherein the cover and the liner each comprise a plurality of panels, and each cover panel is positioned directly over and in contact with a liner panel.

* * * * *